US005832792A

United States Patent [19]

Hsieh

[11] Patent Number: 5,832,792

[45] Date of Patent: Nov. 10, 1998

[54] SOCKET FOR A RATCHET WRENCH

[76] Inventor: Chih-ching Hsieh, No. 64, Lane 107, Lientsun Rd., Fengyuan City, Taichung Hsien, Taiwan

[21] Appl. No.: 638,103

[22] Filed: Apr. 26, 1996

[51] Int. Cl.[6] ..... B25B 13/06

[52] U.S. Cl. ..... 81/124.6; 81/121.1

[58] Field of Search ..... 81/119, 121.1, 81/124.6

[56] References Cited

U.S. PATENT DOCUMENTS 3,903,764 9/1975 Anderson ..... 81/121.1
4,930,378 6/1990 Colvin ..... 81/121.1
5,219,392 6/1993 Ruzicka et al. ..... 81/121.1 X

*Primary Examiner*—D. S. Meislin
*Attorney, Agent, or Firm*—Peterson, Wicks, Nemer & Kamrath, P.A.

[57] ABSTRACT

A socket for a ratchet wrench includes a polygonal recess defined longitudinally therein by at least six side surfaces and corners, a first protrusion and a second protrusion being alternately extending radially from any two adjacent side surfaces defining the polygonal recess, the first protrusion having a notch defined therein which is defined by two edges with different rates of slope, the second protrusion being structured symmetrically to the first protrusion and the first notch about a bisector of the corner located between the first protrusion and the second protrusion.

2 Claims, 7 Drawing Sheets

SOCKET FOR A RATCHET WRENCH

BACKGROUND OF THE INVENTION

1. Field of the Invention

The present invention relates to a socket for a ratchet wrench and more particularly, to a socket having a polygonal recess longitudinally defined therein by at least six side surfaces and six corners, a first protrusion and a second protrusion alternately formed between any two adjacent side surfaces of the recess, each of the first protrusion and the second protrusion having a respective engaging portion formed thereto.

2. Brief Description of the Prior Art

A conventional socket for a ratchet wrench generally has a hexagonal or a dodecagonal recess defined longitudinally therein for receiving a workpiece therein when operated and rotated with the ratchet wrench to tighten or loosen a nut or the like. However, the nut made of softer material is often rounded or worn out by the socket after a long-term utilization and this results in that the nut remains still and the socket rotates about an axis of the nut itself, therefore the purposes as to fasten or to loosen the nut cannot be achieved. Although many modifications of the socket have been designed in the present market, the problem mentioned above still exists.

The present invention intends to provide an improved socket which has a polygonal recess defined therein by at least six side surfaces and corners, a first engaging portion and a second engaging portion are alternately formed to any two adjacent side surfaces so as to mitigate and/or obviate the above-mentioned problems.

SUMMARY OF THE INVENTION

The present invention provides a socket for a ratchet wrench and includes a polygonal recess defined longitudinally therein by at least six side surfaces and corners, a first protrusion and a second protrusion being alternately extending radially from any two adjacent side surfaces defining the polygonal recess. The first protrusion being a triangle has a notch defined therein which is defined by two different edges with different rates of slope, the second protrusion and the second engaging portion being structured symmetrically to the first protrusion and the first engaging portion about a bisector of the corner located between the first protrusion and the second protrusion.

It is an object of the present invention to provide a socket having different engaging portions radially formed to any two adjacent side surfaces of the recess of the socket.

It is yet another object of the present invention to provide a socket which provide an effective contact area to a workpiece received in the socket even if the workpiece is rounded.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
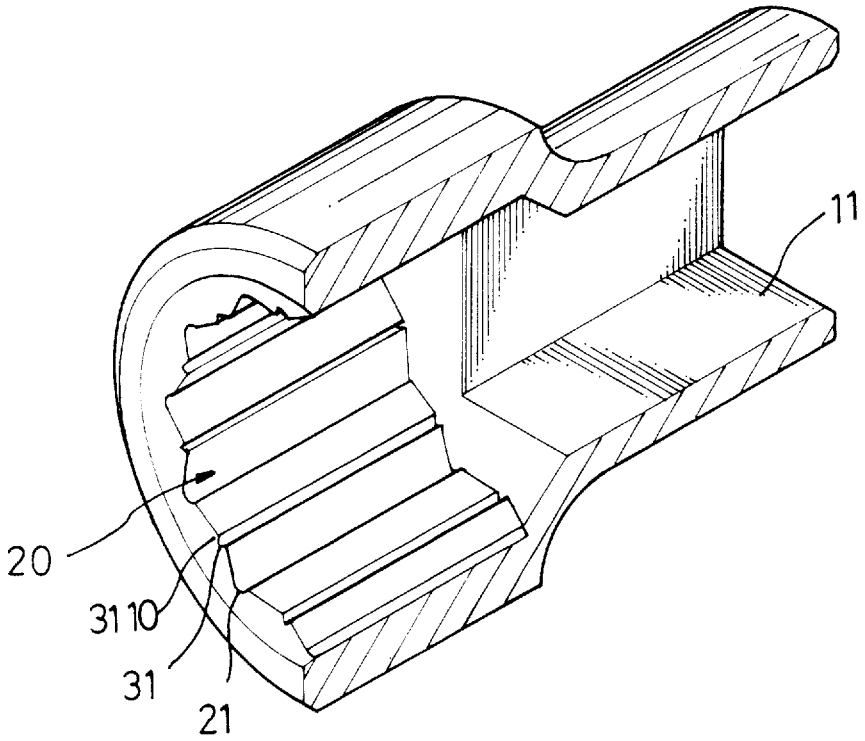
FIG. 1 is a perspective view, partly removed, of a socket in accordance with the present invention.
Figure 2:
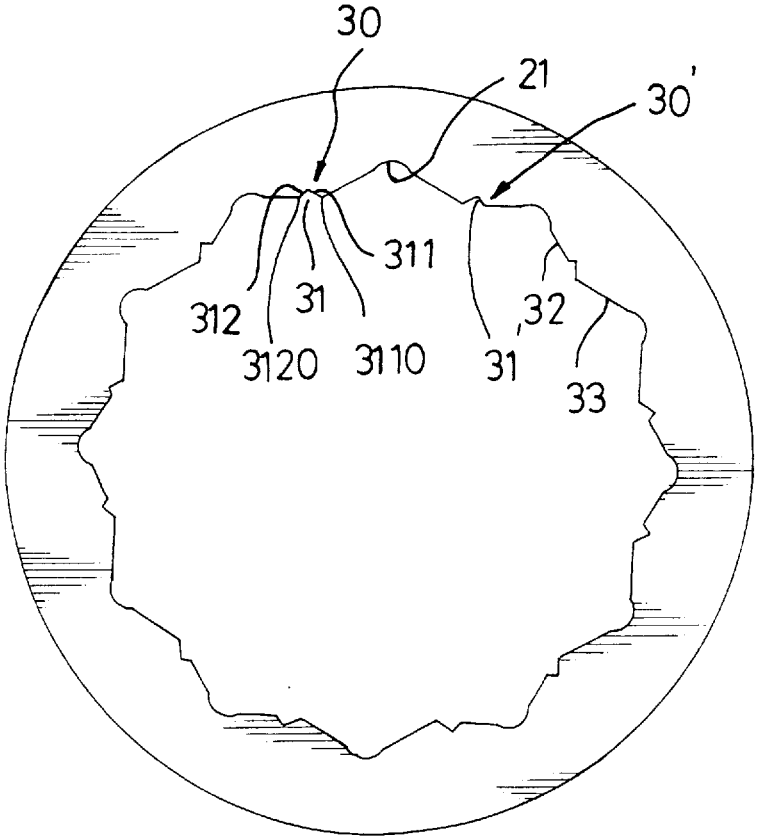
FIG. 2 is an illustrative end elevational view of the socket.

Referring to the drawings and initially to FIGS. 1 and 2, a socket 10 for a ratchet wrench in accordance with the present invention generally is a tubular element and includes a first end and a second end, the first end thereof having a dodecagonal recess 20 defined longitudinally therein by twelve points interconnected together at twelve corners 21. Each of the points includes first and second side surfaces. The second end of the socket 10 has a tetragonal recess 11 longitudinally defined therein so as to co-operate with a ratchet wrench (not shown) and the tetragonal recess 11 communicates with the dodecagonal recess 20.

A first protrusion 30 and a second protrusion 30' alternately extend from any two adjacent points defining the dodecagonal recess 20, the first protrusion 30 having a first engaging portion such as a first notch 31 defined therein and the second protrusion 30' having a second engaging portion such as a second notch 31' defined therein. Each of the first protrusion 30 and the second protrusion 30' has a triangular shape and each of the triangular shapes has two sides 32, 33 extending from the side surface corresponding thereto.

The first notch 31 is defined in the side 32 of the first protrusion 30 and the first notch 31 is defined by a first edge 311 and a second edge 312 wherein the first edge 311 has a lower rate of slope compared to that of the second edge 312 so as to radially form a first extension 3110 and a second extension 3120.

The second protrusion 30' and the second engaging portion which is the second notch 31' are defined symmetrically to the first protrusion 30 and the first notch 31 about a bisector (not shown) of the corner 21 located between the adjacent first protrusion 30 and the second protrusion 30'.

Figure 3:
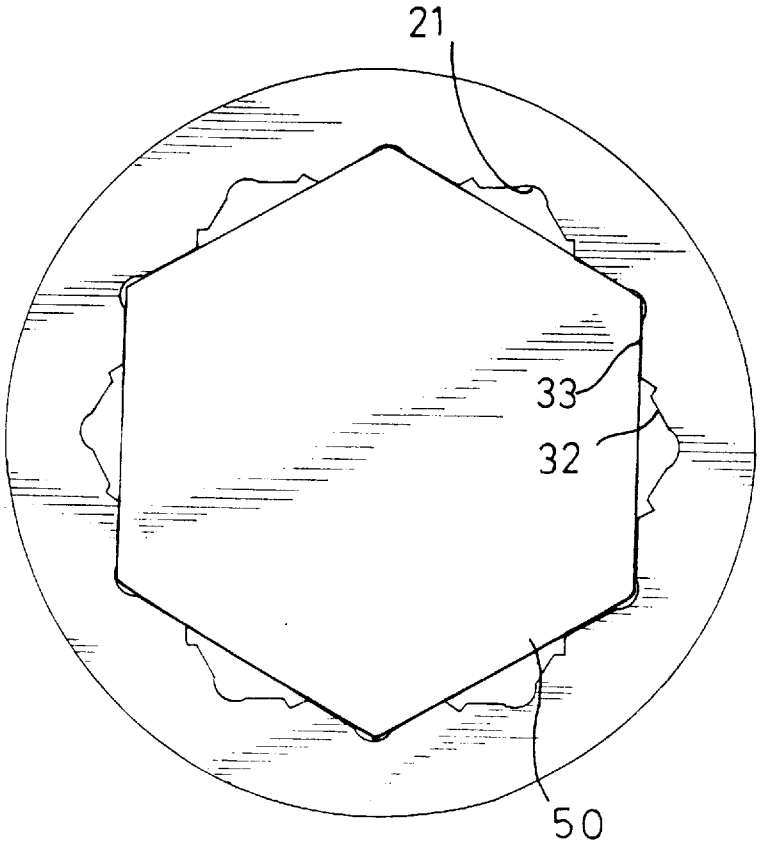
FIG. 3 is an illustrative end elevational view of the socket in which a standard hexagonal workpiece in received.
Figure 4:
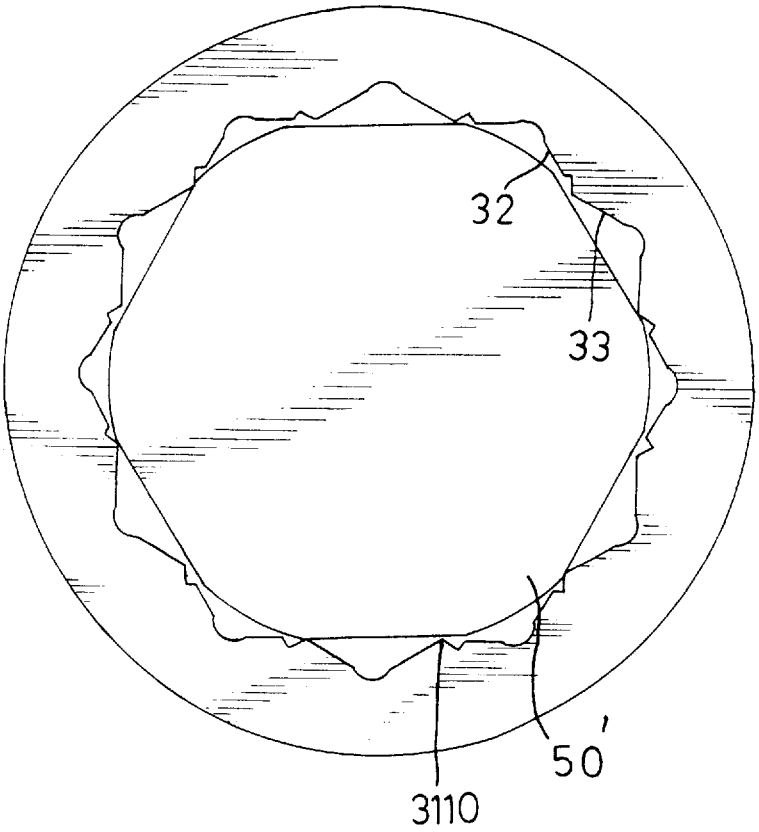
FIG. 4 is an illustrative end elevational view of the socket in which a rounded hexagonal workpiece is received.
Figure 5:
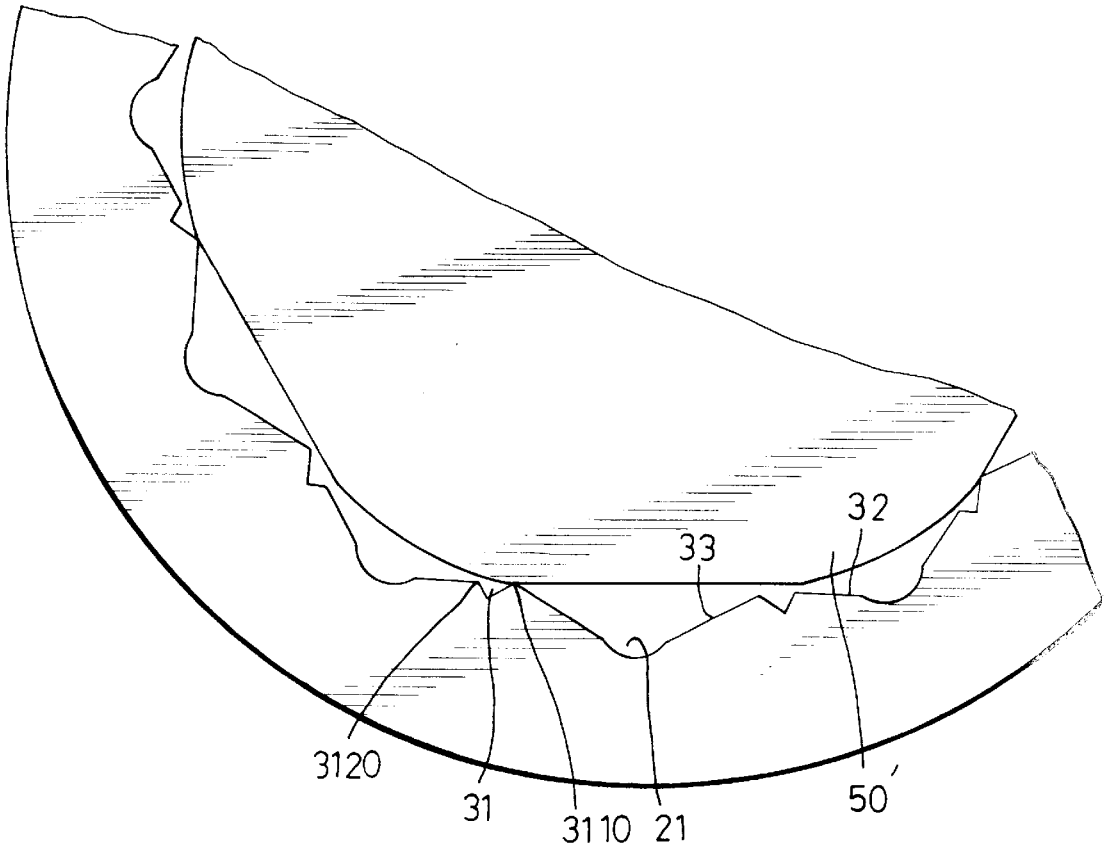
FIG. 5 is a view to show a part of the engagement shown in FIG. 4 in an enlarged scale.

Referring to FIG. 3, a standard hexagonal workpiece 50 can be received in the socket and because the first protrusion 30 and the second protrusion 30' are symmetrical to the bisector of the corner 21 located therebetween as described above, each one of six sides of the workpiece 50 can be urged against the two opposite sides 33 or 32 of the first protrusion 30 and the second protrusion 30' respectively so as to perform a formal function like a conventional socket. Referring to FIGS. 4 and 5, if a rounded workpiece 50' is received in the socket and the socket is going to be rotated clock-wise, every two of the first extensions 3110 will be urged against the workpiece 50' so as to provide an effective contact area to rotate the workpiece 50'. Similarly, if the socket is going to be rotated counter-clock-wise, the rest of the first extensions 3110 different from those urged against the workpiece when rotating clock-wise will urge against the workpiece 50'. Therefore, the socket in accordance with the present invention can effectively co-operate with a hexagonal workpiece even if the workpiece is rounded.

Figure 6:
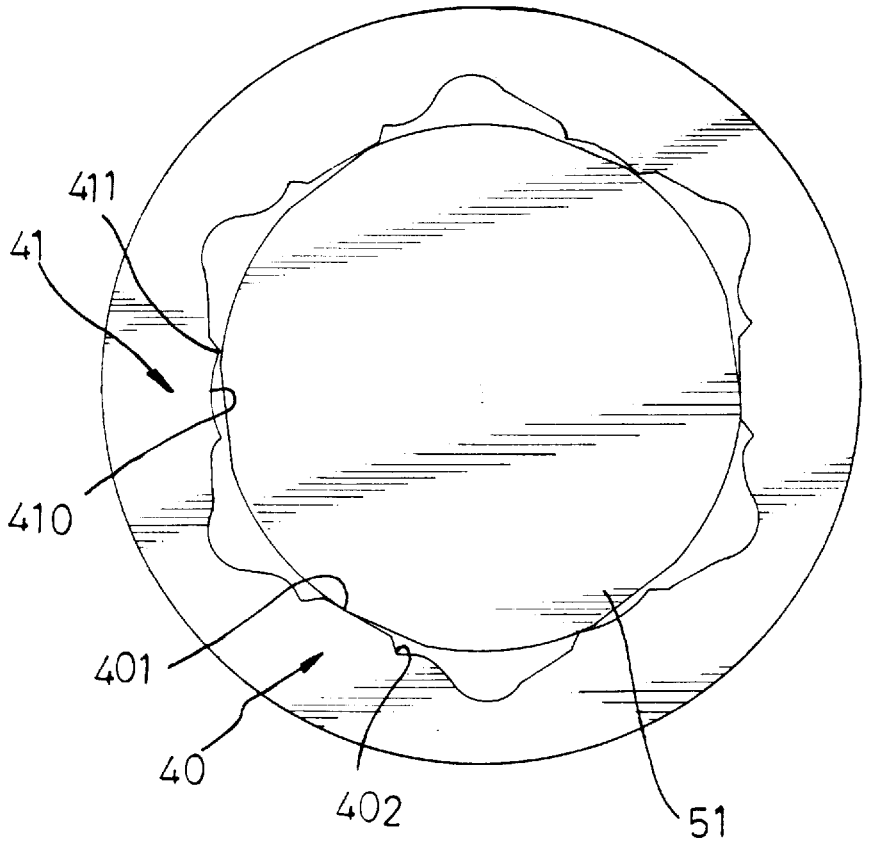
FIG. 6 is an illustrative end elevational view of an embodiment of the socket in which a workpiece is received.

FIG. 6 shows an embodiment of the socket wherein the first end of the socket has a hexagonal recess defined longitudinally therein by six points interconnected together at six corners. A first protrusion 40 and a second protrusion 41 alternately extend from any two adjacent defining the hexagonal recess 20 wherein a recess 402 is defined in the first protrusion 40 and located at each one of two ends of the first protrusion 40. The first protrusion 40 has a first engaging portion which is a plane surface 401 formed thereto and the second protrusion has a second engaging portion which is a concave recess 410 formed thereto so as to form two separate extensions 411 radially from the second protrusion 41. Therefore, when a rounded hexagonal workpiece 51 is received in the socket, the plane surface 401 and some of the extensions 411 will respectively contact the workpiece 51.

Figure 7:
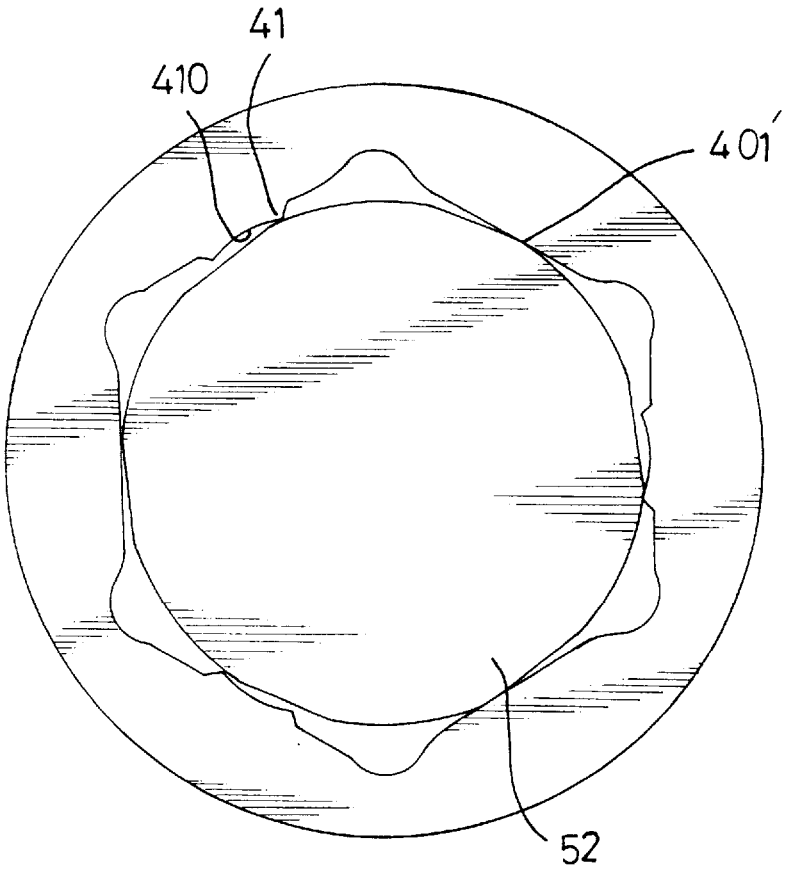
FIG. 7 is an illustrative end elevational view of yet another embodiment of the socket in which a workpiece is received.

FIG. 7 shows yet another embodiment of the socket and which has the same structure as that of the embodiment shown in FIG. 6 except that the plane surface 401' has a longer length than the plane surface 401 and there are no recesses like the recesses 402 shown in FIG. 6 defined in this embodiment as shown in FIG. 7. Accordingly, the socket can also provide the same function as that of the embodiment shown in FIG. 6 if a rounded workpiece 52 is received in the socket.

Although the invention has been explained in relation to its preferred embodiment, it is to be understood that many other possible modifications and variations can be made without departing from the spirit and scope of the invention as hereinafter claimed.

What is claimed is:

1. A socket for a ratchet wrench and comprising:

an element including a first end and a second end, said first end thereof having a polygonal recess defined longitudinally therein by at least six corners;

protrusions extending between adjacent corners defining said polygonal recess;

each of said protrusions extending radially inwardly and having a generally triangular shape and each of said generally triangular shapes having two sides extending from respective corners corresponding thereto;

a first notch defined in one of said two sides of each alternate protrusion and said first notch defined by a first edge and a second edge, with the second edge having a different length and a different rate of slope than the first edge;

each said remaining protrusions including a second notch defined symmetrically to said alternate protrusions and said first notches about a bisector of said corner located between adjacent protrusions.

2. The socket as claimed in claim 1 wherein said second end of said element has a tetragonal recess longitudinally defined therein and said tetragonal recess communicates with said polygonal recess.

* * * * *